US008781378B2

(12) United States Patent
Yamamoto et al.

(10) Patent No.: US 8,781,378 B2
(45) Date of Patent: Jul. 15, 2014

(54) FIXING DEVICE AND IMAGE FORMING APPARATUS

(75) Inventors: Naoki Yamamoto, Toyohashi (JP); Mamoru Fukaya, Nagoya (JP); Noboru Yonekawa, Toyohashi (JP); Toru Hayase, Toyohashi (JP)

(73) Assignee: Konica Minolta, Inc., Tokyo (JP)

( * ) Notice: Subject to any disclaimer, the term of this patent is extended or adjusted under 35 U.S.C. 154(b) by 343 days.

(21) Appl. No.: 13/112,346

(22) Filed: May 20, 2011

(65) Prior Publication Data

US 2011/0293340 A1 Dec. 1, 2011

(30) Foreign Application Priority Data

May 31, 2010 (JP) ..... 2010-123863

(51) Int. Cl.
*G03G 15/20* (2006.01)

(52) U.S. Cl.
USPC ..... 399/329

(58) Field of Classification Search
USPC ..... 399/88, 329
See application file for complete search history.

(56) References Cited

U.S. PATENT DOCUMENTS

| | | | | |
|---|---|---|---|---|
| 5,084,738 | A * | 1/1992 | Ishikawa | 399/329 |
| 5,724,637 | A * | 3/1998 | Senba et al. | 399/333 |
| 5,822,670 | A * | 10/1998 | Morigami | 399/334 |
| 5,839,023 | A * | 11/1998 | Morigami | |
| 5,899,599 | A * | 5/1999 | Kato | 399/69 |
| 6,944,420 | B2 * | 9/2005 | Kanamori et al. | 399/329 |
| 7,190,917 | B2 * | 3/2007 | Suzumi et al. | 399/88 |
| 2001/0050019 | A1 | 12/2001 | Ezaki et al. | |
| 2009/0169231 | A1 * | 7/2009 | Asakura et al. | |
| 2009/0257795 | A1 | 10/2009 | Kageyama | |

FOREIGN PATENT DOCUMENTS

| | | | |
|---|---|---|---|
| CN | 1311462 | | 9/2001 |
| CN | 101561653 | | 10/2009 |
| JP | 9-120223 | | 5/1997 |
| JP | 2003-050515 | * | 2/2003 |
| JP | 2003-50515 | | 2/2003 |
| JP | 2006-350241 | | 12/2006 |
| JP | 2009-109997 | | 5/2009 |

OTHER PUBLICATIONS

Notification of Reasons for Refusal mailed Mar. 27, 2012, directed to Japanese Application No. 2010-123863; 6 pages.
First Office Action mailed May 23, 2013, directed to CN Application No. 201110132364.1; 20 pages.

* cited by examiner

*Primary Examiner* — Sandra Brase
(74) *Attorney, Agent, or Firm* — Holtz Holtz Goodman & Chick PC

(57) ABSTRACT

A fixing device for thermally fixing an unfixed image onto a recording sheet by causing the sheet to pass through a fixing nip. The fixing device includes: heat belt formed in an endless shape and provided with a resistance heat layer; first pressure member provided inside a running path of the heat belt; and second pressure member pressing the first pressure member from over the running path to form the fixing nip. At least one of the first and second pressure members is rotating body. The heat belt has a pressure-receiving area and two non-pressure areas. The pressure-receiving area receives pressures from both the first and second pressure members. The non-pressure areas have been arranged at outside of the pressure-receiving area in an axis direction of the rotating body. Two ring-like electrodes have been formed on circumferential surfaces of the non-pressure areas and are used to supply power to the resistance heat layer.

20 Claims, 11 Drawing Sheets

FIXING DEVICE AND IMAGE FORMING APPARATUS

This application is based on application No. 2010-123863 filed in Japan, the contents of which are hereby incorporated by reference.

BACKGROUND OF THE INVENTION (1) Field of the Invention

The present invention relates to a fixing device and an image forming apparatus using the fixing device, and in particular to a technology for extending the life of a fixing belt in a fixing device, the fixing belt including a resistance heat layer and electrode layers for supplying power to the resistance heat layer.

(2) Description of the Related Art

Among conventional image forming apparatuses such as printers, there are some that have adopted a fixing device that uses a fixing belt containing a resistance heat layer, the fixing device being able to conserve more energy than a fixing device that uses a halogen heater as the heat source, as disclosed in, for example, Japanese Patent Application Publication No. 2009-109997.

FIG. 11 is a perspective view illustrating an example of the structure of such a fixing unit 500.

As shown in FIG. 11, the fixing unit 500 includes a fixing belt 554, a pressure roller 550, a pressurizing roller 560, and a pair of power supply rollers 570 connected to an AC power source.

The fixing belt 554 is a cylindrical, flexible and deformable belt provided with a resistance heat layer 554*b*, and on the circumference of the fixing belt 554 at the two end portions in the width direction (Y axis direction), electrodes 554*e* are respectively formed on the resistance heat layer.

The pressure roller 550 is composed of a cored bar 551 and an elastic layer 552, wherein the cored bar 551 is covered with the elastic layer 552, and the pressure roller 550 is movably inserted in the inside of a running path of the fixing belt 554.

The pressurizing roller 560 is provided over the running path of the fixing belt 554, and presses the pressure roller 550 via the fixing belt 554, thereby forming a fixing nip therebetween.

Also, the pressurizing roller 560 receives a driving force from a driving motor (not illustrated) and rotates in the direction indicated by the arrow P shown in FIG. 11. This driving force is conveyed to the pressure roller 550 via the fixing belt 554, and causes the fixing belt 554 and the pressure roller 550 to rotate passively in the direction indicated by the arrow Q shown in FIG. 11.

The pair of power supply rollers 570 are structured to contact with the respective electrodes 554*e* of the fixing belt 554 from over the running path of the fixing belt 554, and press the electrodes downward in FIG. 11. This causes power to be supplied to the resistance heat layer 554*b* of the fixing belt 554.

When the fixing belt 554 is driven to move cyclically and power is supplied to the electrodes 554*e*, power is supplied to the resistance heat layer 554*b* of the fixing belt 554, and then the whole resistance heat layer 554*b* is heated.

In the above state, the fixing belt 554 is only in contact with the fixing nip 530 and the pair of power supply rollers 570, thus the fixing nip 530 is effectively heated, and a toner image having been formed on a recording sheet (not illustrated) is fixed on the recording sheet by the heat and pressure when the recording sheet passes through the fixing nip 530.

However, when the fixing unit 500 is driven, the electrodes 554*e* of the fixing belt 554 are deformed as they receive pressures from both the pressurizing roller 560 and the pressure roller 550 repeatedly in the fixing nip 530. Thus a problem of the conventional fixing device is that a peel-off is easy to occur and the life of the fixing belt 554 is short.

SUMMARY OF THE INVENTION

One aspect of the present invention provides a fixing device for thermally fixing an unfixed image onto a recording sheet by causing the recording sheet, with the unfixed image formed thereon, to pass through a fixing nip, the fixing device comprising: a heat belt formed in an endless shape and provided with a resistance heat layer; a first pressure member provided inside a running path of the heat belt; and a second pressure member configured to press the first pressure member via the heat belt from over the running path of the heat belt to form the fixing nip, at least one of the first pressure member and the second pressure member being a rotating body, the heat belt including a pressure-receiving area and two non-pressure areas, the pressure-receiving area receiving pressures from both the first pressure member and the second pressure member, and the non-pressure areas being arranged at outside of the pressure-receiving area in an axis direction of the rotating body, and two ring-like electrodes having been formed on circumferential surfaces of the respective two non-pressure areas and used to supply power to the resistance heat layer.

Another aspect of the present invention provides an image forming apparatus comprising a fixing device for thermally fixing an unfixed image onto a recording sheet by causing the recording sheet, with the unfixed image formed thereon, to pass through a fixing nip, the fixing device including: a heat belt formed in an endless shape and provided with a resistance heat layer; a first pressure member provided inside a running path of the heat belt; and a second pressure member configured to press the first pressure member via the heat belt from over the running path of the heat belt to form the fixing nip, at least one of the first pressure member and the second pressure member being a rotating body, the heat belt including a pressure-receiving area and two non-pressure areas, the pressure-receiving area receiving pressures from both the first pressure member and the second pressure member, and the non-pressure areas being arranged at outside of the pressure-receiving area in an axis direction of the rotating body, and two ring-like electrodes having been formed on circumferential surfaces of the respective two non-pressure areas and used to supply power to the resistance heat layer.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENT

First Embodiment

The following describes the first embodiment of the present invention pertaining to the image forming apparatus, taking a tandem color digital printer (hereinafter, merely referred to as "printer") as an example, with reference to the drawings.

Figure 1:
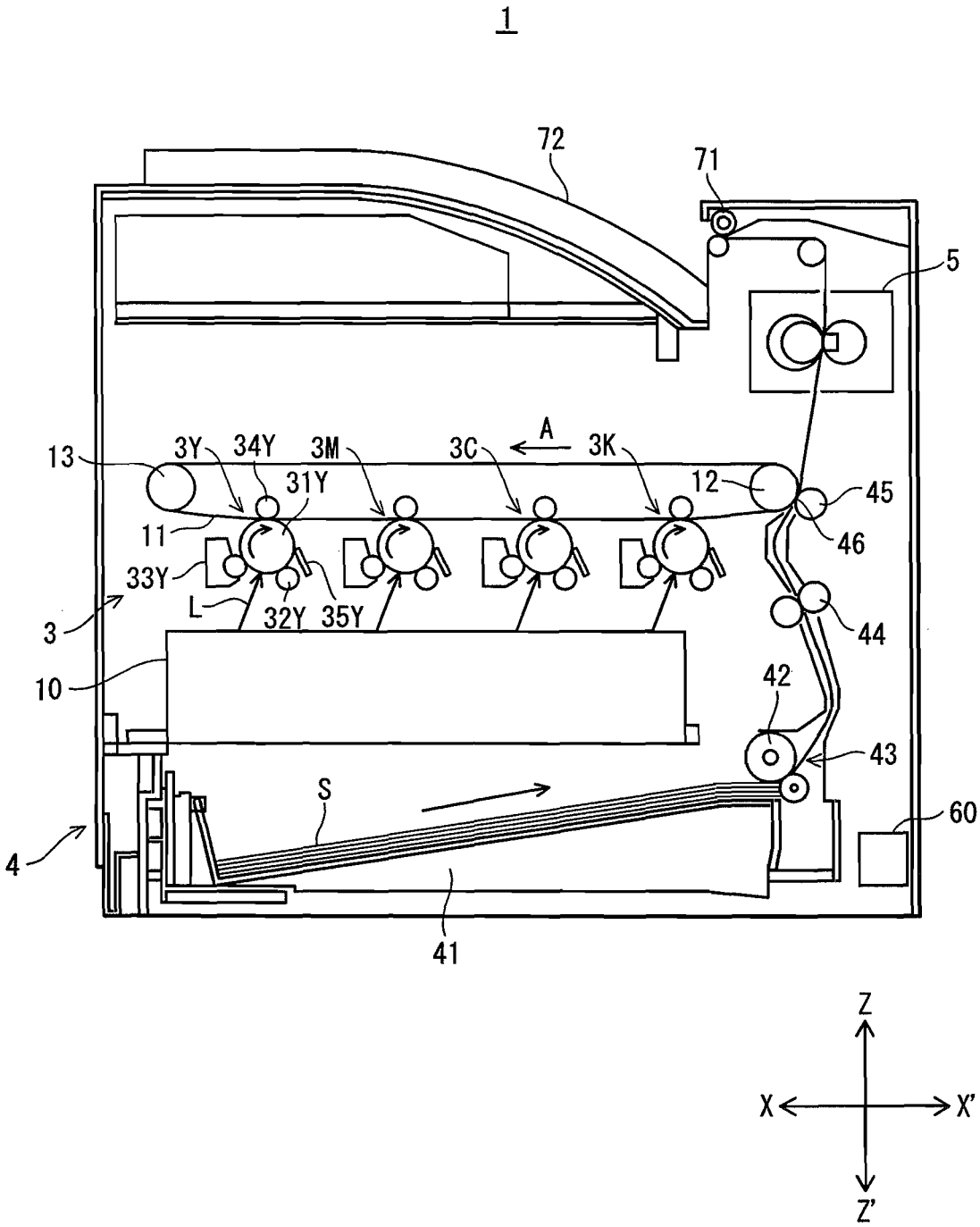
FIG. 1 is a cross-sectional view showing an overall structure of a printer in the first embodiment of the present invention.

FIG. 1 is a cross-sectional view showing an overall structure of a printer 1 in the present embodiment.

As shown in FIG. 1, the printer 1 includes an image processor 3, a paper feeder 4, a fixing unit 5, and a controller 60, and is connected to a network (such as a LAN). Upon receiving a request to execute a print job from an external terminal device (not illustrated), the printer 1 forms toner images of yellow, magenta, cyan, and black based on the instruction, and forms a full-color image by performing a multi-transfer, namely, by transferring the toner images of these colors.

Hereinafter, the reproduction colors of yellow, magenta, cyan, and black are represented by Y, M, C, and K, respectively, and any structural component related to one of the reproduction colors is represented by a numeral attached with a corresponding character, Y, M, C, or K.

<Image Processor>

The image processor 3 includes image creating units 3Y, 3M, 3C, and 3K corresponding respectively to colors Y, M, C, and K, an optical unit 10, and an intermediate transfer belt 11.

The image creating unit 3Y is provided with a photosensitive drum 31Y and around the photosensitive drum 31Y: a charger 32Y; a developing unit 33Y; a first transfer roller 34Y; and a cleaner 35Y for cleaning the photosensitive drum 31Y. The image creating unit 3Y creates a toner image of color Y on the photosensitive drum 31Y. The other image creating units 3M through 3K have the same structure as the image creating unit 3Y, and thus reference signs for these units are omitted in FIG. 1.

The intermediate transfer belt 11 is an endless-state belt, suspended with a tension between a drive roller 12 and a passive roller 13, and is driven to move cyclically in the direction indicated by the arrow "A".

The optical unit 10 is provided with light-emitting devices such as laser diodes, which, in accordance with a drive signal from the controller 60, emit laser beams L for forming images of colors Y-K and expose-scan the photosensitive drums 31Y-31K.

This expose-scanning causes electrostatic latent images to be formed on the photosensitive drums 31Y-31K having been charged by the chargers 32Y-32K. The electrostatic latent images are developed by the developing units 33Y-33K, and toner images of colors C-K are formed on the photosensitive drums 31Y-31K, respectively. The formations of the electrostatic latent images are performed at shifted timings so that the toner images are layered and transferred at the same position on the intermediate transfer belt 11, which is referred to as "first transfer.

Toner images of respective colors are transferred onto the intermediate transfer belt 11 in sequence by the electrostatic action of the first transfer rollers 34Y-34K, and the transferred toner images for the full-color move toward a second transfer position 46 as the intermediate transfer belt 11 moves.

On the other hand, the paper feeder 4, which includes: a paper feed cassette 41 that houses recording sheets S; a feed roller 42 for feeding the recording sheets S one by one from the paper feed cassette 41 to a transport passage 43; and a pair of timing rollers 44 for adjusting the timing for feeding a recording sheet S to the second transfer position 46, feeds a recording sheet S toward the second transfer position 46 at the timing corresponding to the timing at which the toner images on the intermediate transfer belt 11 move. The toner images on the intermediate transfer belt 11 are transferred onto a recording sheet S in block by the action of the second transfer roller 45. This image transfer is referred to as "second transfer".

The recording sheet S having passed through the second transfer position 46 is transported to the fixing unit 5, in which it is heated and pressed, so that the toner image (unfixed image) on the recording sheet S is fixed onto the recording sheet S, and the recording sheet S is ejected onto a tray 72 via a pair of ejection rollers 71.

<Fixing Unit>

Figure 2:
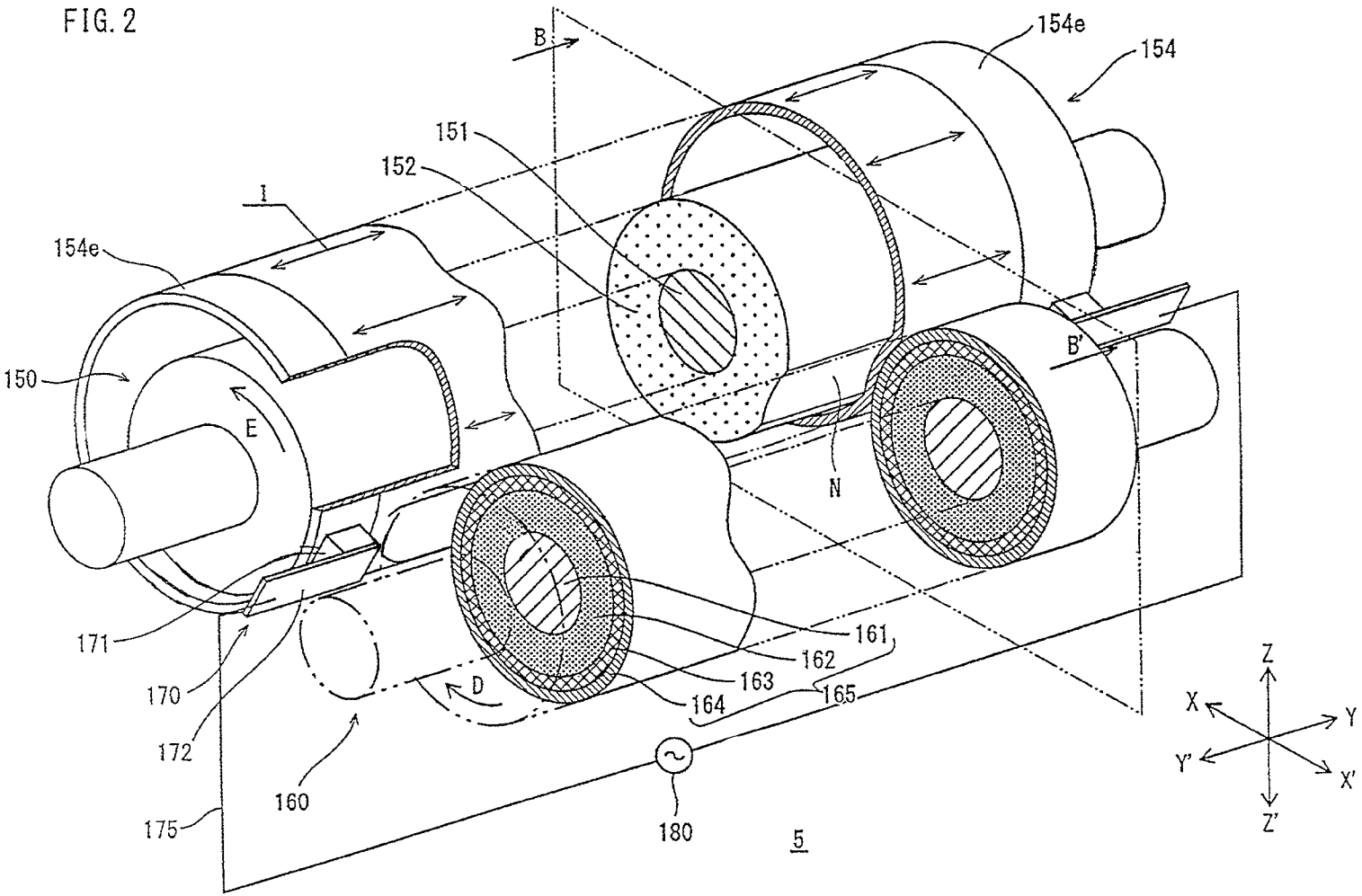
FIG. 2 is a partial cross-sectional perspective view showing the structure of the fixing device in the first embodiment of the present invention.
Figure 3:
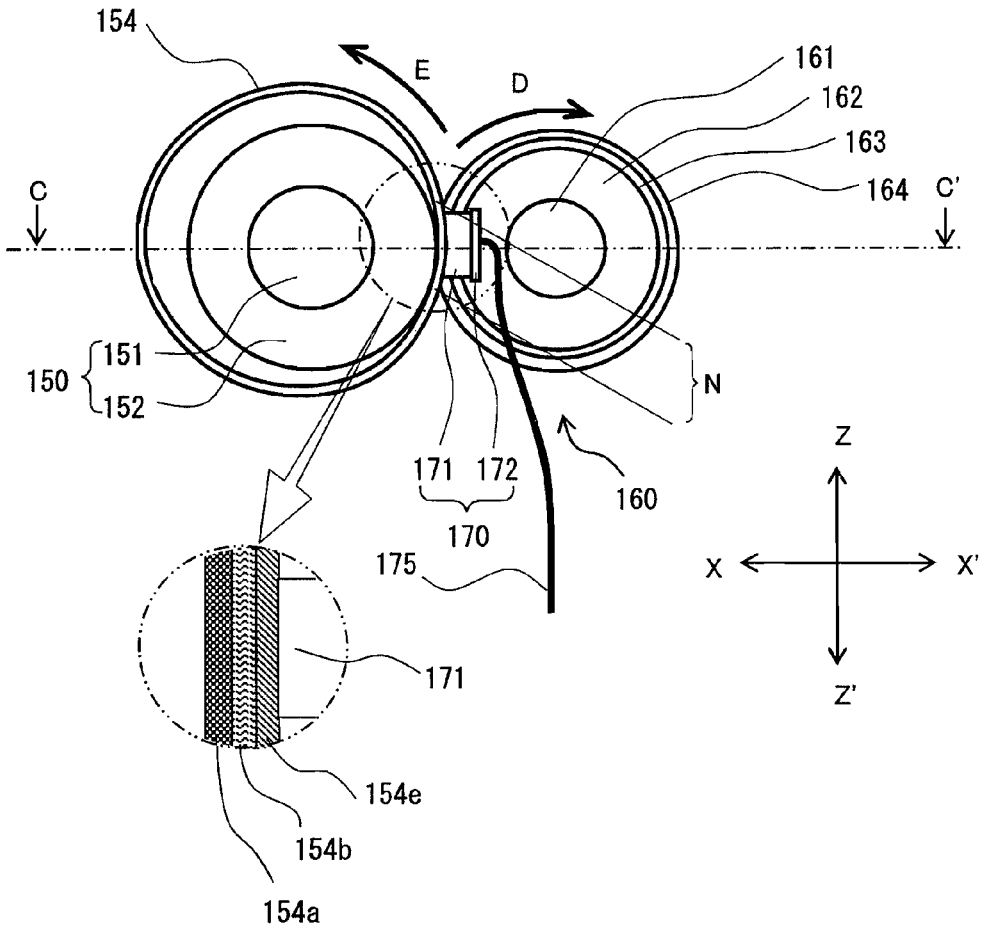
FIG. 3 is a cross sectional view of the fixing device in the first embodiment of the present invention.

FIG. 2 is a partial cross-sectional perspective view showing the structure of the fixing unit 5. FIG. 3 is a cross sectional view showing the main part of the fixing unit, taken along plane B-B' of FIG. 2.

As shown in FIG. 2, the fixing unit 5 is provided with a fixing belt 154, a pressure roller 150, a pressurizing roller 160, and power feed members 170.

The pressure roller 150 is set with an allowance in the inside of the running path of the fixing belt 154.

Also, the pressurizing roller 160, which is set at a position over the running path of the fixing belt 154, presses the pressure roller 150 via the fixing belt 154 from outside of the fixing belt 154 while it is driven by a driving mechanism (not illustrated) to rotate in the direction indicated by the arrow D.

This causes the fixing belt 154 and the pressure roller 150 to rotate passively in the direction indicated by the arrow E, forming a fixing nip N between the pressurizing roller 160 and the surface of the fixing belt 154.

When the recording sheet (not illustrated) passes through the fixing nip N while the fixing nip N is maintained at a target temperature, heat and pressure are given therein and the unfixed toner image on the recording sheet is fixed by heat on the recording sheet.

The following describes in detail the structure of the fixing unit 5.

<Pressure Roller>

The pressure roller 150 is composed of a long cylindrical cored bar 151 and an elastic layer 152 formed on the circumferential surface of the cored bar 151.

The cored bar 151 is in the shape of a cylinder whose outer diameter is approximately 20 mm, and is made of, for example, aluminum, iron, or stainless, and both ends in the axis direction thereof are supported, in a rotatable state, by bearings (not illustrated) provided on the frame of the fixing unit 5 on the printer body side.

The elastic layer 152 is made of a highly heat-resistant or heat-insulating, foamed elastic material such as a silicone rubber or a fluorine-containing rubber. The elastic layer 152 is in the range from 1 mm to 20 mm in thickness. Thus the outer diameter of the pressure roller 150 is set to be in the range from 20 mm to 100 mm. In the present example, the outer diameter of the pressure roller 150 is set to 30 mm.

In the present example, the length of the elastic layer 152 in the Y axis direction is 360 mm.

Hereinafter, "the length of the pressure roller" refers to the length of the elastic layer in the Y axis direction.

Of course, the length of the elastic layer 152 in the Y axis direction is set to be larger than the maximum paper-passing width of the recording sheet S.

<Pressurizing Roller>

The pressurizing roller 160 is composed of a cored bar 161, an elastic layer 162, a bonding layer 163, and a releasing layer 164, wherein the elastic layer 162, bonding layer 163, and releasing layer 164 are laminated on the circumferential surface of the cored bar 161 in this order so that the releasing layer 164 is the outermost layer.

The cored bar 161 is, for example, a solid shaft made of aluminum whose outer diameter is approximately 30 mm, and is driven to rotate by a driving mechanism (not illustrated).

The elastic layer 162 is made of a silicone rubber, cylindrical, and 330 mm long in the Y axis direction.

The thickness of the elastic layer 162 is preferably in the range from 1 mm to 20 mm, and is set to 3 mm in the present example.

The elastic layer 162 is set to be higher in hardness than the elastic layer 152 of the pressure roller 150. Thus the elastic layer 152 of the pressure roller 150 is mainly deformed in the fixing nip N.

The releasing layer 164 is formed from a fluorine-containing resin such as PTFE (polytetrafluoroethylene resin) or PFA (copolymer of tetrafluoroethylene and perfluoroalkoxyethylene), having a thickness in the range from 10 μm to 50 μm.

The bonding layer 163 is made of, for example, a silicone adhesive, and is formed by applying the adhesive to the surface of the elastic layer 162.

It should be noted here that the three layers, the elastic layer 162, the bonding layer 163, and the releasing layer 164 (hereinafter the three layers are generically referred to as a "laminate 165"), have the same length in the Y axis direction.

Hereinafter, "the length of the pressurizing roller" refers to the length of the laminate in the Y axis direction.

<Power Feed Member>

The power feed members 170 are electrically connected with an external power supply 180 via lead wires 175, and feed the power to a pair of electrode layers 154*e*, which will be described later, of the fixing belt 154 when the power feed members 170 contact with the pair of electrode layers 154*e*.

Here, the power supply 180 is, for example, a power supply for domestic use at 100 V of voltage and 50 Hz or 60 Hz of frequency.

Note that relay switches (not illustrated) which turn ON/OFF in accordance with an instruction from the controller 60 are inserted in the lead wires 175, and the current is caused to flow in the relay switches as necessary.

The power feed members 170 are each composed of a brush 171 and a plate spring 172.

Each of the brushes 171 is, for example, a block in the shape of a rectangular solid of 15 mm in vertical length, 10 mm in horizontal length, and 5 mm in thickness, and is what is called a carbon brush made of a material having the slidability and electrical conductivity, such as copper-graphite or carbon-graphite.

Each of the plate springs 172 is a rectangular plate made of a material having electrical conductivity and elasticity, such as copper phosphate, wherein one end thereof is fixed to an insulation on the printer 1's body side, and the other end is connected with the brush 171 by, for example, an adhesive having electrical conductivity.

The plate springs 172, as shown in FIG. 3, constitute power supply passages of the brushes 171, and press the brushes 171 against the circumferential surfaces of the pair of electrode layers 154*e*, which will be described later.

<Fixing Belt>

Figure 4:
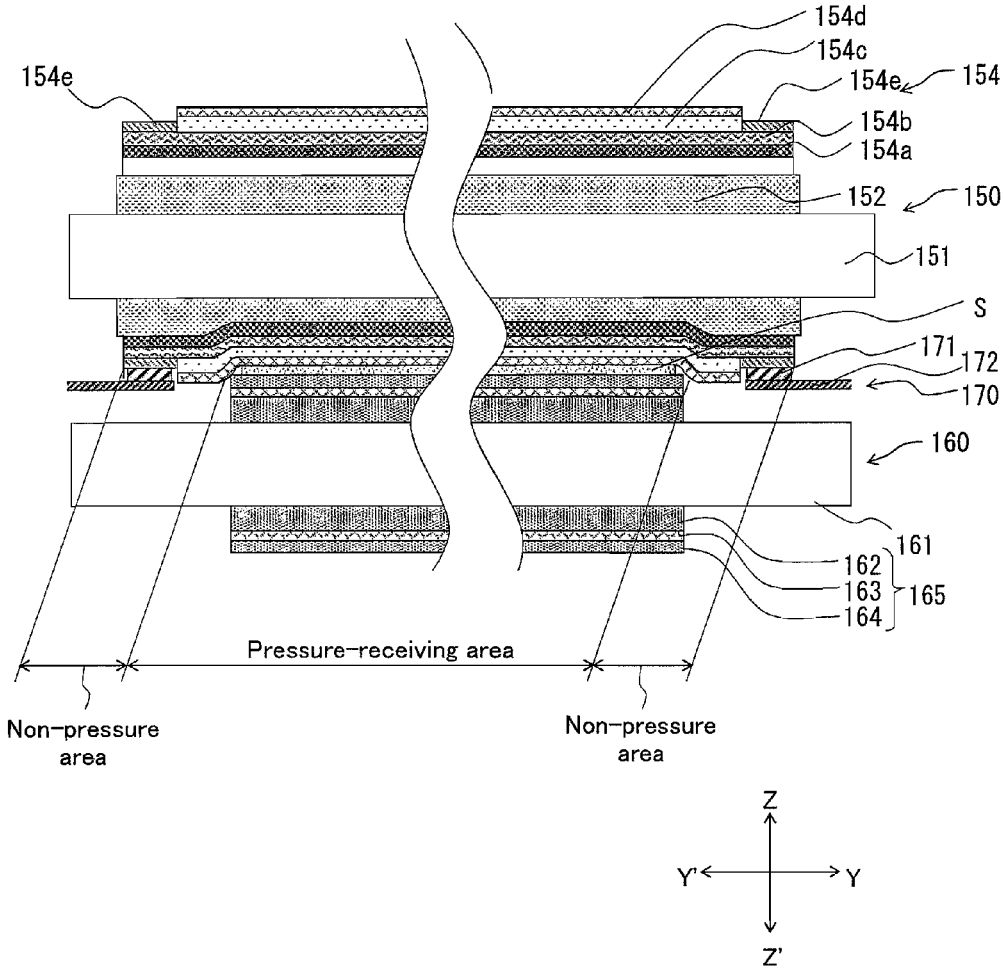
FIG. 4 is a cross-sectional view taken along a line extending in the direction of the roller axis of the fixing device in the first embodiment of the present invention.

FIG. 4 is a cross-sectional view taken along a line extending in the direction of the rotation axis (hereinafter merely referred to as "roller axis direction") of the pressurizing roller 160 of the fixing device in the first embodiment.

The fixing belt 154 is a flexible, deformable endless belt formed as a laminate of a plurality of layers which are made of different materials.

As shown in FIG. 4, in the fixing belt 154, two end portions in the Y axis direction and the remaining central portion differ from each other in the laminate structure.

More specifically, the two end portions and the central portion of the fixing belt 154 in the Y axis direction have in common a reinforcement layer 154*a* and a resistance heat layer 154*b*, wherein the reinforcement layer 154*a* and the resistance heat layer 154 are laminated in this order so that the resistance heat layer 154*b* is on the outer surface side.

The central portion further includes an elastic layer 154*c* and a releasing layer 154*d* as well as the reinforcement layer 154*a* and the resistance heat layer 154*b*, wherein the elastic layer 154*c* and the releasing layer 154 are laminated in this order on the resistance heat layer 154*b*.

On the other hand, in each of the two end portions, an electrode layer 154*e* is laminated on the resistance heat layer 154*b*.

The following describes in detail each layer constituting the fixing belt 154.

The reinforcement layer 154*a* is a film made of a non-electrically conductive material, such as PI (polyimide), PPS (polyphenylenesulfide resin), or PEEK (polyether ether ketone), and its thickness is preferably in the range from 10 μm to 200 μm, and in the present example, it is set to 50 μm.

The two electrode layers 154*e* are formed on the circumferential surface of the respective two end portions of the resistance heat layer 154*b*, the two end portions being present at ends in the Y axis direction.

More specifically, the electrode layers 154*e* are films made of, for example, a material having low electrical resistivity such as Cu, Ni, Ag, Al, Au, Mg, a brass, or an alloy of any of these materials, and are formed by plating the outer circumferential surfaces of the two end portions of the resistance heat layer 154*b*, the two end portions being ends in the Y axis direction.

The electrode layers 154*e* may be formed in other ways, for example, by pasting the two end portions of the resistance heat layer 154*b* in the Y axis direction with belt-like films made of any of the above materials by, for example, an adhesive having electrical conductivity.

Also, it is preferable that each of the electrode layers 154*e* is 15 mm long in the Y axis direction, and its thickness is in the range from 0.1 μm to 20 μm. In the present embodiment, the thickness is set to 5 μm.

The two electrode layers 154*e* formed with a distance therebetween in the Y axis direction function as a pair of ring-like electrodes that supply power to the resistance heat layer 154*b* when they are in contact with the respective power feed members 170.

In contrast to a conventional structure in which the electrode layers are formed in an area where the fixing belt 154 receives a pressure from both the pressure roller 150 and the pressurizing roller 160 (hereinafter the area is referred to as "pressure-receiving area"), in the fixing unit 5 of the first embodiment, as shown in FIG. 4, the pair of electrode layers 154*e* are formed in two areas to be arranged at outside of the pressure-receiving area in a direction perpendicular to the rotational direction of the fixing belt 154 (hereinafter the areas are referred to as "non-pressure areas").

For this reason, no large force is applied to the electrode layers 154*e*, and a local deformation hardly occurs therein. Thus a peel-off is difficult to occur.

Figure 5:
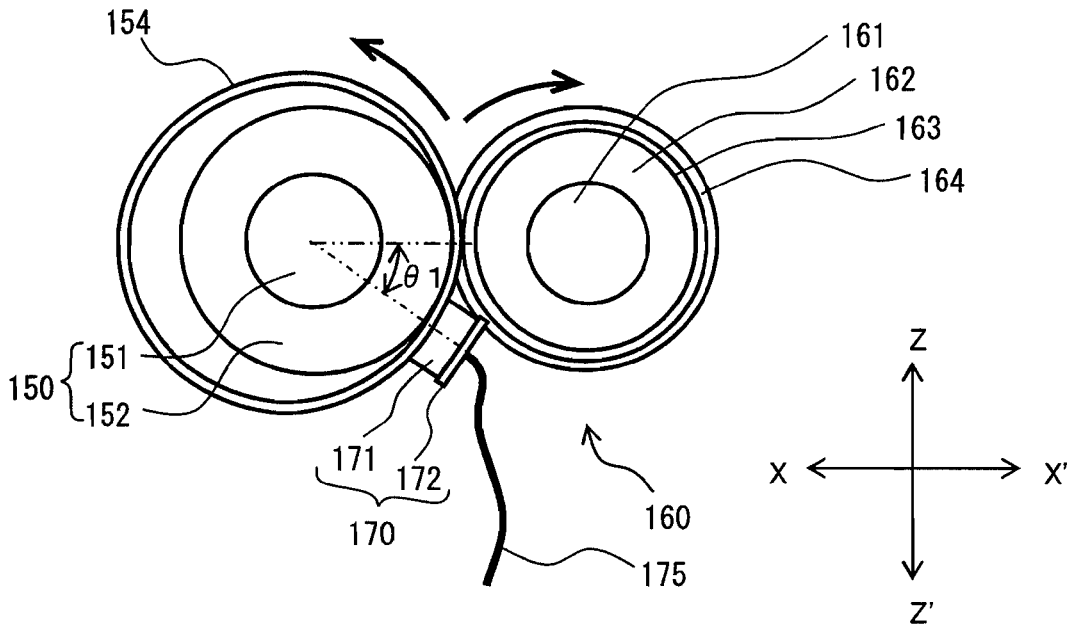
FIG. 5 is a side view of a fixing device in a modification.

Note that the power feed members 170 that are to contact with the electrode layers 154*e* are provided in the non-pressure areas, and as shown in FIG. 5, the power feed members 170 may be shifted by an angle θ01 from a line connecting the rotational axes of the pressure roller 150 and the pressurizing roller 160 when viewed from the rotation axis direction of the pressure roller 150.

Here, the larger the value of angle θ1 is, the larger the contact area between the fixing belt 154 and the pressure roller 150 is, and the lower the temperature-rise speed is. Accordingly, the angle θ1 needs to be set to a value that does not cause the temperature-rise speed to be lower than a target lowest speed.

The resistance heat layer 154*b* is a film that produces heat known as Joule heat when a potential difference occurs between the pair of electrode layers 154*e* and electric currents flow concurrently in the Y axis direction.

More specifically, the resistance heat layer 154*b* is a film whose thickness is in the range from 5 μm to 100 μm, and is made of a PI (polyimide) resin in which one or more types of electrically conductive fillers having different values of electric resistivity are distributed uniformly.

Also, the length of the resistance heat layer 154*b* in the Y axis direction is 370 mm.

As the base material of the resistance heat layer 154*b*, other materials, such as PPS or PEEK, are usable.

Here, as the electrically conductive filler, a metal such as Ag, Cu, Al, Mg, or Ni, or a carbon-based material such as a carbon nanotube or a carbon nanofiber may be used. It is preferable that the electrically conductive filler is fibrous so that the probability of contact between the electrically conductive fillers per unit content can be increased.

In the first embodiment, pieces of fibrous electrically conductive filler made of, for example, Ni are distributed into the base material uniformly.

When the above-mentioned power supply for domestic use is used as the power supply 180, the volume resistivity, which is set to obtain a target amount of heat generation, is preferably in the approximate range from "10×10^−6Ω·m" to "9.9×10^−3Ω·m". Furthermore, in the specification of the fixing unit 5 of the present embodiment, the volume resistivity is preferably set to be in the range from "10×10^−5Ω·m" to "5.0×10^−3Ω·m".

The elastic layer 154*c* is made of, for example, a material that is elastic and heat-resistant, such as a silicone rubber, and is approximately 200 μm thick.

Also, not limited to the silicone rubber, the elastic layer 154*c* may be made of, for example, a fluorine-containing rubber.

The releasing layer 154*d* is a film that is made of a material having a releasing characteristic, like fluorine-containing resin such as the PTFE or the PFA, and its thickness is in the range from 5 μm to 100 μm.

With the above structure of the fixing unit 5 in the first embodiment in which the electrode layers 154*e* of the fixing belt 154 are formed in the non-pressure areas being arranged at outside of the pressure-receiving area, not in the pressure-receiving area in which the fixing belt 154 receives a pressure from both the pressure roller 150 and the pressurizing roller 160, the electrode layers 154*e* neither receive a large external force nor are deformed largely when the fixing unit 5 is driven. This prevents occurrence of a peel-off in the electrode layers 154*e*, extending the life of the fixing belt 154.

Also, in the structure of the first embodiment, the pressure roller 150 is sufficiently longer than the pressurizing roller 160 and extends in the Y axis direction to the back side (the inner circumferential surfaces) of the two electrode layers 154*e*, thus the power feed member 170 can press, against the pressure roller 150, the portions of the fixing belt 154 where the electrode layers 154*e* have been formed, and the electrode layers 154*e* do not recede even if they are pressed by the power feed member 170. Thus the contact pressure between the power feed members 170 and the electrode layers 154*e* is maintained at a high level.

Also, in the pressurizing roller 160 that is set to be shorter than the pressure roller 150, the length and position of the laminate 165 in the Y axis direction match the length and position of the pressure-receiving area in the Y axis direction. Accordingly, it is possible to determine appropriate length and position of the pressure-receiving area by determining the length of the laminate 165 in the Y axis direction and a position relative to the pressure roller 150.

Second Embodiment

The structure of the fixing device in the second embodiment is basically the same as the fixing device in the first embodiment except for the structure of the fixing belt, the measurements of the elastic layer of the pressure roller and the laminate of the pressurizing roller in the Y axis direction, and the position where the power supply member is attached.

In the following description, the same structural components as those in the first embodiment are assigned the same reference signs and description thereof is omitted or simplified, and the differences are mainly described.

Figure 6:
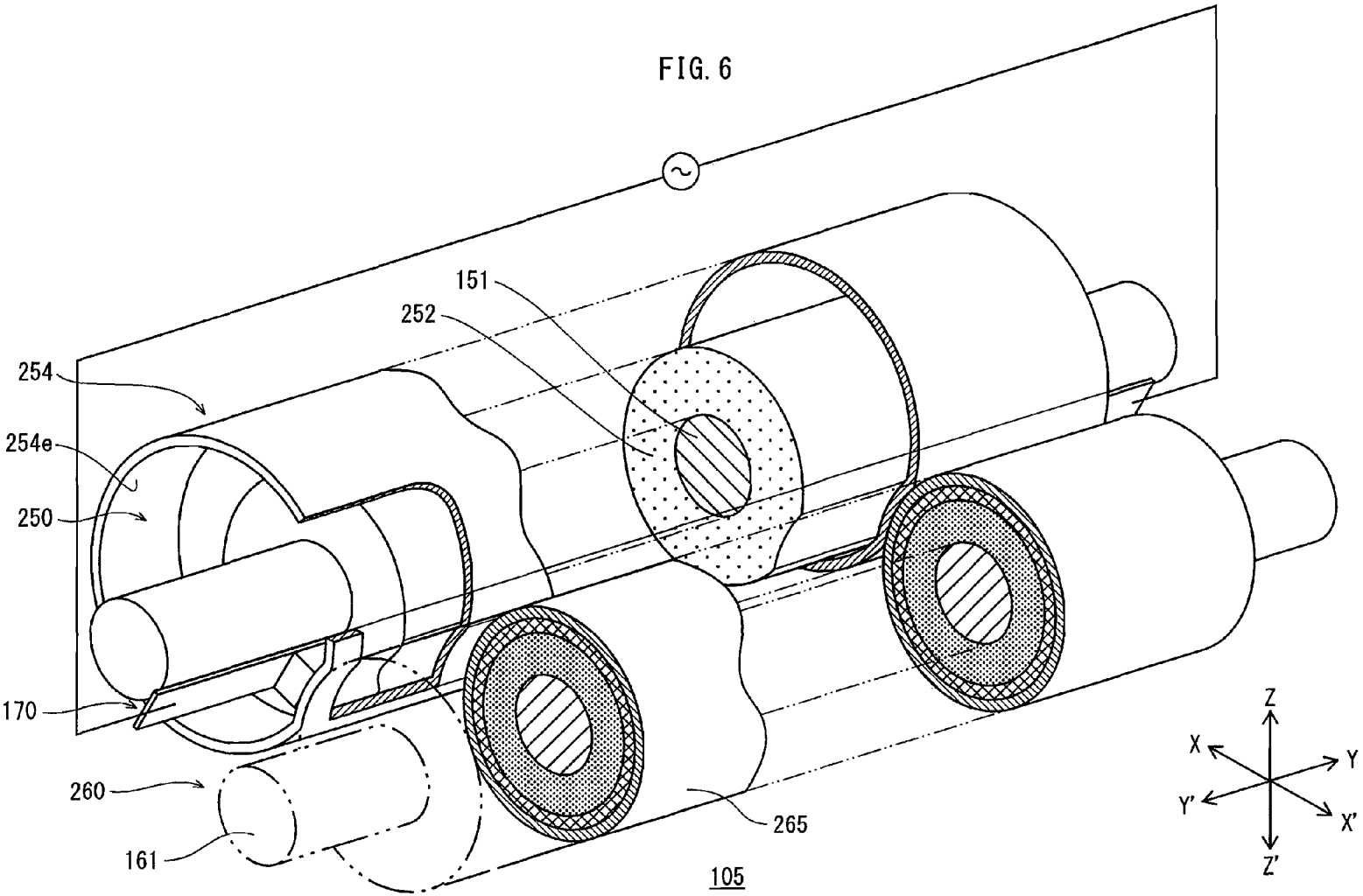
FIG. 6 is a partial cross-sectional perspective view showing the structure of the fixing device in the second embodiment of the present invention.
Figure 7:
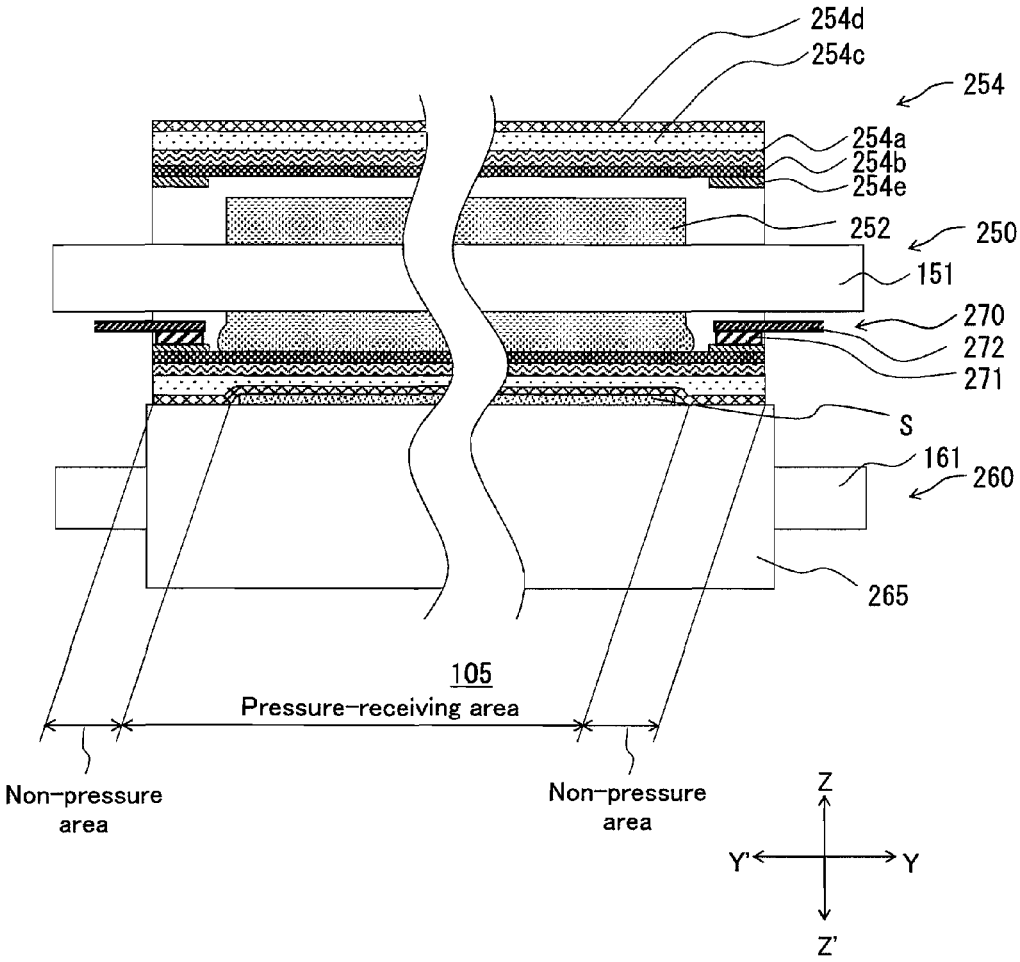
FIG. 7 is a cross-sectional view taken along a line extending in the direction of the roller axis direction of the fixing device in the second embodiment of the present invention.

FIG. 6 is a partial cross-sectional perspective view showing the structure of the main part of the fixing device in the second embodiment. FIG. 7 is a cross-sectional view taken along a line extending in the direction of the roller axis direction of the fixing device in the second embodiment.

As shown in FIG. 6, as is the case with the fixing unit 5 of the first embodiment, a fixing unit 105 of the second embodiment is provided with a fixing belt 254, a pressure roller 250, a pressurizing roller 260, and the power feed members 170.

In the second embodiment, the elastic layer 252 of the pressure roller 250 is set to be shorter than the laminate 265 of the pressurizing roller 260 in length in the Y axis direction, which is a difference from the first embodiment.

More specifically, the pressurizing roller 260 (the laminate 265 in the Y axis direction) is the same as the pressure roller 150 (the elastic layer 152 in the Y axis direction) of the first embodiment in length, and the pressure roller 250 (the elastic layer 252 in the Y axis direction) is the same as the pressurizing roller 160 (the laminate 165 in the Y axis direction) of the first embodiment in length.

That is to say, the lengths of the pressure roller and the pressurizing roller in the fixing unit 105 of the second embodiment are reversed with those in the fixing unit 5 of the first embodiment.

Furthermore, in the second embodiment, the power feed members 170 are positioned to be in contact with the inner circumferential surfaces of both ends of the fixing belt 254.

This is because the fixing belt 254 is different in structure from the fixing belt 154 of the first embodiment.

In the following, the fixing belt 254 will be described.

<Fixing Belt>

FIG. 7 is a cross-sectional view taken along a line extending in the direction of the roller axis direction of the fixing device in the second embodiment.

The fixing belt 254 is a flexible, deformable endless belt formed as a laminate of a plurality of layers which are made of different materials. The fixing belt 254, as the fixing belt 154 of the first embodiment, includes a reinforcement layer 254*a*, a resistance heat layer 254*b*, an elastic layer 254*c*, a releasing layer 254*d*, and electrode layers 254*e*. However, the layers are laminated in a different state from the fixing belt 154.

It should be noted here that the layers having the same names both in the first and second embodiments are the same except for the length in the Y axis direction and the lamination order.

More specifically, the two end portions and the central portion of the fixing belt 254 in the Y axis direction have in common the resistance heat layer 254*b*, the reinforcement layer 254*a*, the elastic layer 254*c*, and the releasing layer 154*d* that are laminated in this order so that the releasing layer 154*d* is the outermost layer.

Furthermore, two electrode layers 254*e* are laminated on the inner circumferential surface of the resistance heat layer 254*b* at the respective end portions of the fixing belt 254 in the Y axis direction so that the electrode layers 254*e* are the innermost layers.

As understood from this, in the fixing belt 254, the electrode layers 254*e* are provided in the non-pressure areas, not in the pressure-receiving area, the non-pressure areas being arranged at outside of the pressure-receiving area where the fixing belt 254 receives a pressure from both the pressurizing roller 260 and the pressure roller 250.

With this structure, the electrode layers 254*e* neither receive a large external force when the fixing unit 105 is driven. This prevents occurrence of a peel-off in the electrode layers 254*e*, extending the life of the fixing belt 254.

Note that, as shown in FIG. 6, as the fixing unit 105 is driven, the pressure-receiving area of the fixing belt 254 is deformed, and the deformation having occurred there affects the non-pressure areas, so that the electrode layers 254*e* are deformed as well. However, the deformation occurring in the electrode layers 254*e* is different from the deformation occurring in the state where both front and back surfaces receive a pressure from the rollers sandwiching thereof, and the stress generated by the deformation in the electrode layers 254*e* is small, and not sufficient enough to cause a peel-off to occur.

Also, in the structure of the second embodiment, the pressurizing roller 260 is sufficiently longer than the pressure roller 250 and extends to the front side (the outer circumferential surfaces) of the two electrode layers 254*e* in the Y axis direction, thus the power feed member 170 can press, against the pressurizing roller 260, the portions of the fixing belt 254 where the electrode layers 254*e* have been formed, and the electrode layers 254*e* do not recede even if they are pressed by the power feed member 170. Thus the contact pressure between the power feed members 170 and the electrode layers 254*e* is maintained at a high level.

Also, in the pressurizing roller 250 that is set to be shorter than the pressure roller 260, the length and position of the laminate 252 in the Y axis direction match the length and position of the pressure-receiving area in the Y axis direction. Accordingly, it is possible to determine appropriate length and position of the pressure-receiving area by determining the length of the laminate 252 in the Y axis direction and a position relative to the pressure roller 260.

<Modifications>

The present invention is not limited to the above embodiments, but can be modified as follows, for example.

(1) In the above embodiments, the fixing belt 154 includes the reinforcement layer 154*a*, resistance heat layer 154*b*, elastic layer 154*c*, releasing layer 154*d*, and electrode layers 154*e*. However, not limited to this, the present invention only needs to have at least the resistance heat layer 154*b* and the electrode layers 154*e*.

For example, in a monochrome copier, compared with a color copier, a degradation in the fixing quality is not remarkable even if the fixing nip width is small. In that case, the elastic layer 154*c* in the fixing belt 154 may be omitted.

(2) In the above embodiment, the power feed members 170 press the brushes 171 in the shape of a block against the electrode layers 154*e* of the pressurizing roller 160. However, not limited to this, for example, metal rollers may be used in stead of the brushes 171 to be in contact with the electrode layers 154*e*, reducing the friction with the electrode layers 154*e*.

(3) In the above embodiment, the pressure roller 150 is set with an allowance in the inside of the running path of the fixing belt 154. However, not limited to this, the pressure roller 150 may be set without an allowance in the inside of the running path of the fixing belt 154.

(4) In the above embodiments, the fixing nip, through which the fixing belt 154 passes through, is formed between rotating bodies (for example, between the pressure roller 150 and the pressurizing roller 160). However, not limited to this, only one of the sandwiching members may be a rotating body, and the other may be a fixed member which does not rotate.

Figure 8:
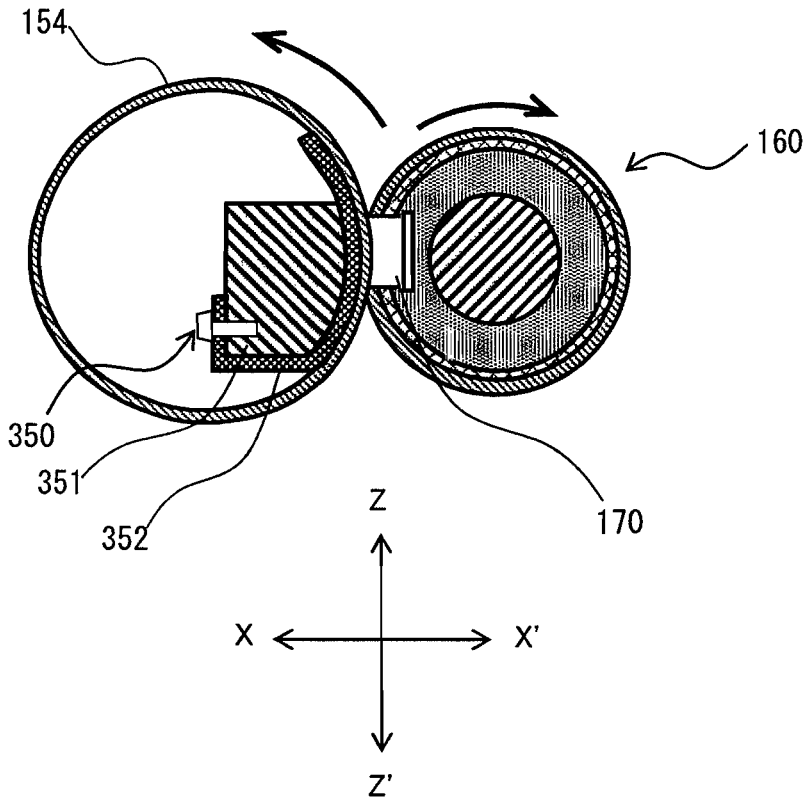
FIG. 8 is a cross-sectional view of a fixing device in a modification.

FIG. 8 illustrates one example of the structure of the fixing device in such a modification.

In this example, a pressure member 350, in stead of the pressure roller 150, is movably inserted in the inside of the running path of the fixing belt 154.

Here, the pressure member 350 includes an elastic member 351 that is long in a direction perpendicular to the page, and a slipping sheet 352 provided to cover a part of the circumferential surface of the elastic member 351.

That is to say, the fixing belt 154 has: a pressure-receiving area configured to receive pressures from both the first pressure member and the second pressure member, at least one of which is a rotating body; and two non-pressure areas being arranged at outside of the pressure-receiving area in an axis direction of the rotating body.

Also, two ring-like electrode layers 154*e* have been formed on circumferential surfaces of the respective two non-pressure areas of the fixing belt 154 and are used to supply power to the resistance heat layer 154*b*.

With this structure, the electrode layers 154*e* of the fixing belt 154 are not pressed at once from the first pressure member and the second pressure member, and no large force is applied to the electrode layers 154*e*. Thus a peel-off is difficult to occur, and the life is extended.

(5) In the above embodiment, the pressure roller 150 and the pressurizing roller 160 have different lengths in the Y axis direction so that a pair of electrode layers 154*e* are provided in the non-pressure areas of the fixing belt 154. However, not limited to this, the pressure roller 150 and the pressurizing roller 160 may have the same length to provide the electrode layers 154*e* in the non-pressure areas.

Figure 9:
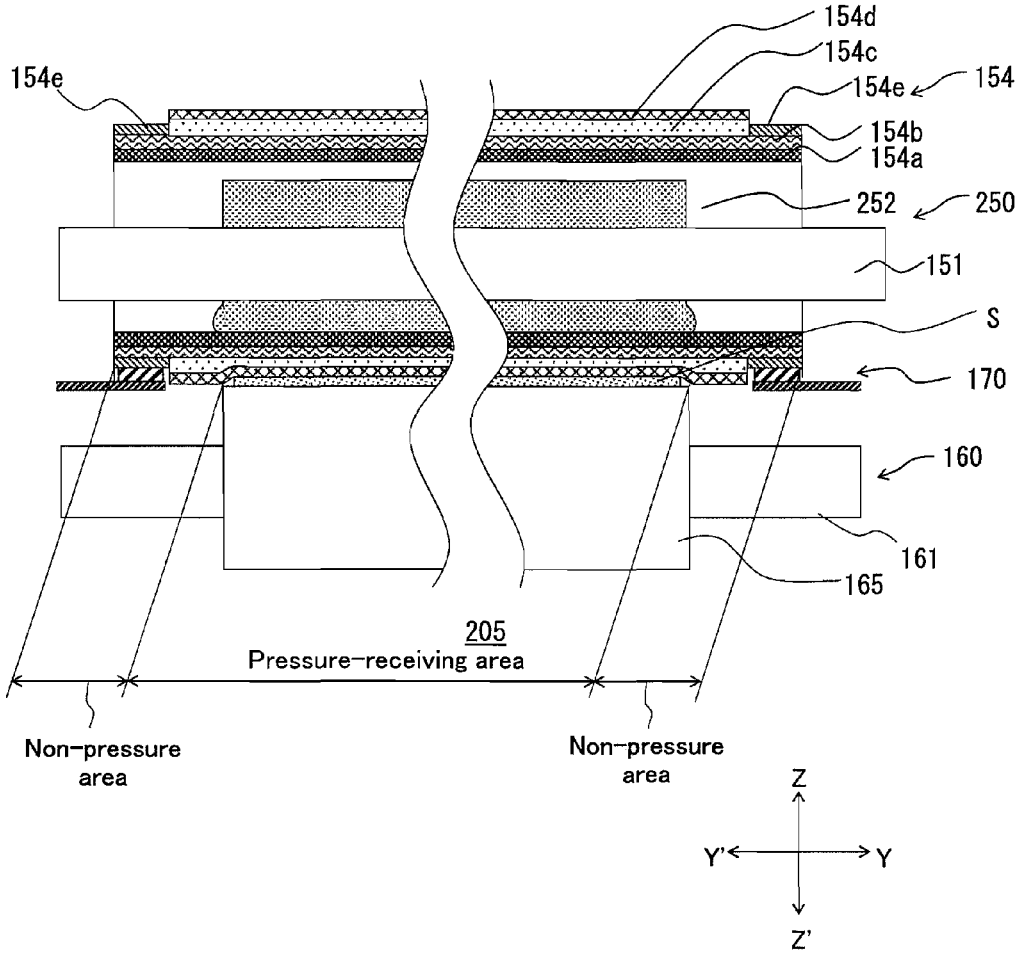
FIG. 9 is a cross-sectional view taken along a line extending in the direction of the roller axis direction of a fixing device in a modification.

FIG. 9 is a cross-sectional view taken along a line extending in the direction of the roller axis direction of a fixing device 205, showing one example of this structure.

Basically, the fixing device 205 has the same structure as the fixing unit 105 of the first embodiment except for the measurement in the Y axis direction of the elastic layer of the pressure roller.

That is to say, the fixing device 205 includes a pressure roller 250, which has an elastic layer 252 that is the same as the laminate 165 of the pressurizing roller 160 in the length in the Y axis direction.

The length of the elastic layer 252 is shorter than a distance between the electrode layers 154*e*, and the laminate 165 and the elastic layer 252 are provided on the inner side of the electrode layers 154*e* in the Y axis direction, thus the electrode layers 154*e* are in contact with neither the pressure roller 250 nor the pressurizing roller 160.

The fixing belt 154 has stiffness to some extent, thus the deformation that occurs in the pressure-receiving area affects areas which are extensions of the pressure-receiving area in the Y axis direction as well (hereinafter, the areas are referred to as "extension areas").

Therefore outer surfaces of the electrode layers 154*e* in the extension areas are dented, like the fixing belt 154 shown in FIG. 6.

It is possible to maintain a contact pressure to some extent by causing the power feed members 170 to enter the dent and contact with the electrode layers 154*e* from over the running path of the fixing belt 154, even if there is no member pressing the back side.

Figure 10:
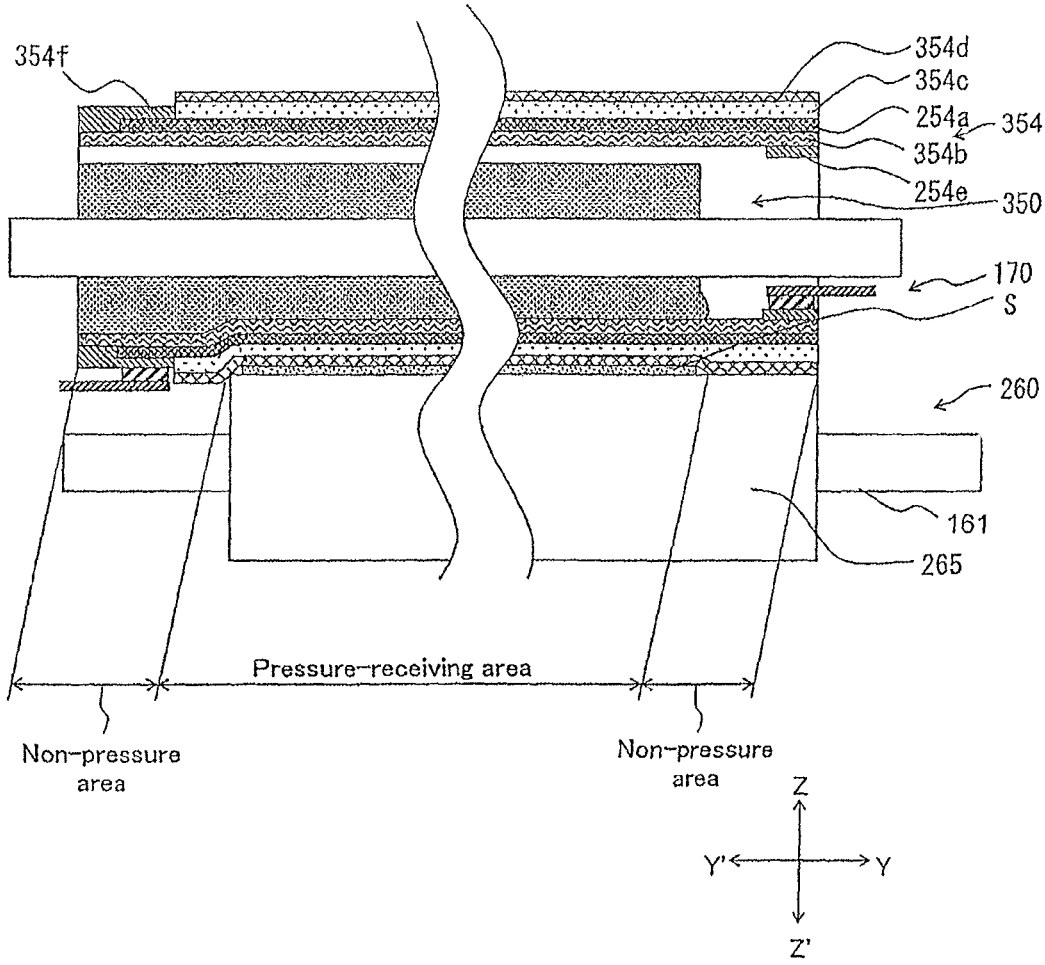
FIG. 10 is a cross-sectional view taken along a line extending in the direction of the roller axis direction of a fixing device in a modification.
Figure 11:
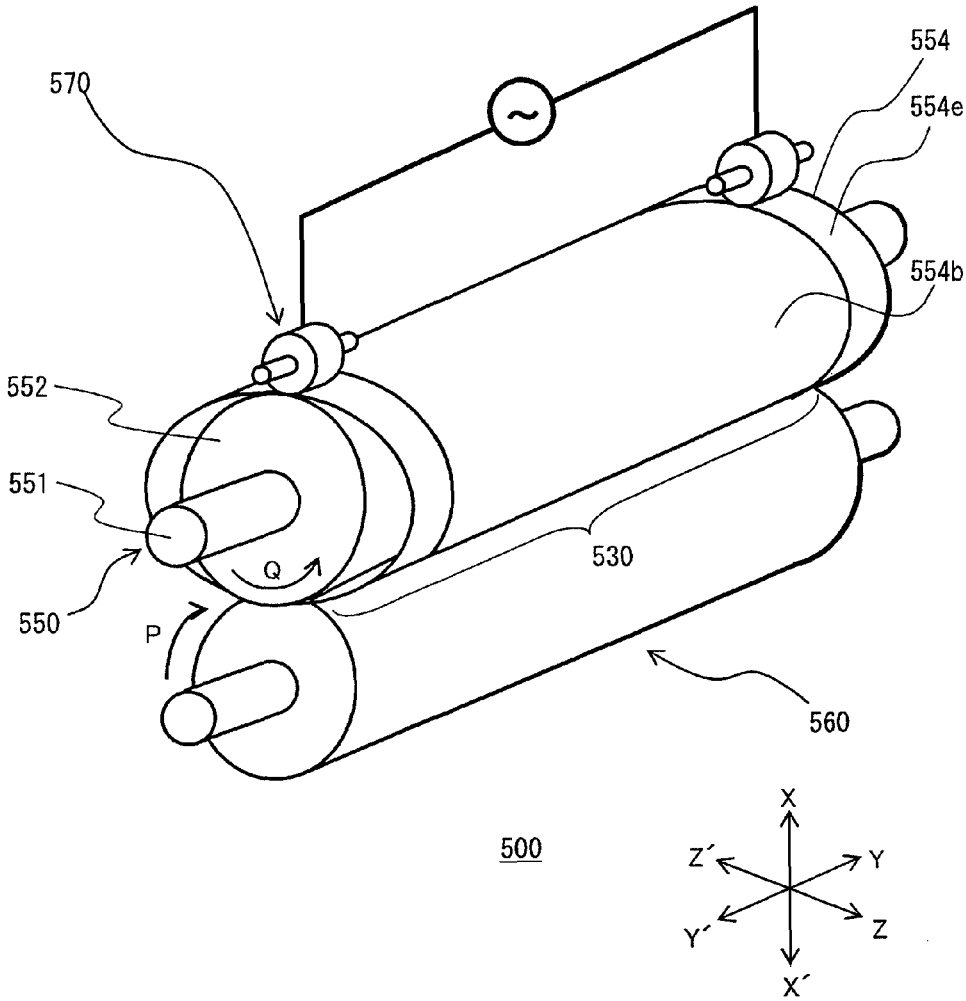
FIG. 11 Prior Art
FIG. 11 is a perspective view of a fixing device in a conventional image forming apparatus.

In the structure having been explained up to now, both the laminate 165 and the elastic layer 252 are shorter than the distance between the electrode layers 154*e* in length in the Y axis direction. However, as shown in FIG. 10, even if the laminate 165 and the elastic layer 252 are each longer than the distance between the electrode layers 154*e*, the electrode layers 154*e* can be provided in the non-pressure areas of the fixing belt 154.

For example, the pressure roller 150 and the pressurizing roller 260 may be provided at the positions having been offset from each other in the Y axis direction so that the elastic layer 162 and a laminate 265 are partially pressed via a fixing belt 354.

In this structure, one of the pair of power feed members 170 on the Y' direction side is provided at the same position as the fixing unit 5 of the first embodiment, and the other on the Y direction side is provided at the same position as the fixing unit 105 of the second embodiment.

Furthermore, the fixing belt 354 is basically the same as the fixing belt 254 of the second embodiment in structure except for the end portion on the Y' direction side.

More specifically, in the end portion of the fixing belt 354 on the Y' direction side, the end of a resistance heat layer 354*b* extends further toward the outside in the Y' direction than the end of the reinforcement layer 254*a*, and the ends of an elastic layer 354*c* and a releasing layer 354*d* recede further toward the inside in the Y direction than the end of the reinforcement layer 254*a*.

Also, an electrode layer 354*f* positioned on the Y' direction side is the outermost layer and is structured to cover the end portion of the reinforcement layer 254*a* and the end portion of the resistance heat layer 354*b*.

This structure makes it possible for the power feed member 170 on the Y' direction side to contact with the electrode layer 354*f* from over the running path of the fixing belt 354, and for the power feed member 170 on the Y direction side to contact with the electrode layer 254*e* from the inside of the running path of the fixing belt 354. Furthermore, since the laminate 265 and the elastic layer 162 are present on the back surfaces of the portions with which the electrode layer 354*f* and the electrode layer 254*e* of the fixing belt 354 contact, respectively, the contact pressure of the power feed members 170 is increased.

(6) In the above embodiment, the pressurizing roller 160 is driven to rotate, and the pressure roller 150 is rotated passively. However, structures other than this are applicable.

For example, the pressure roller 150 may be driven to rotate, and the pressurizing roller 160 may be rotated passively. Also, both the pressure roller 150 and the pressurizing roller 160 may be driven to rotate.

(7) In the above embodiment, the elastic layer 152 of the pressure roller 150 is set to be lower than the elastic layer 162 of the pressurizing roller 160 in hardness, and in the fixing nip N, the elastic layer 152 of the pressure roller 150 is mainly deformed in shape. However, not limited to this, the elastic layer 152 may be set to be higher than or equal to the elastic layer 162 in hardness as far as the fixing quality is not degraded.

(8) In the above embodiments, as one example, the image forming apparatus of the present invention is applied to a tandem color digital printer. However, not limited to this, the present invention is applicable to a fixing device in which a first pressure member is set on the inside of the running path of the fixing belt, and a fixing nip is formed when the first pressure member is pressed by a second pressure member via the fixing belt, wherein at least one of the first and second pressure members is rotatable. Also, the present invention is applicable in general to an image forming apparatus that is provided with this fixing device.

Also, the present invention may be any combination of the above embodiments and modifications.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A fixing device for thermally fixing an unfixed image onto a recording sheet by causing the recording sheet, with the unfixed image formed thereon, to pass through a fixing nip, the fixing device comprising:

a heat belt formed in an endless shape and provided with a resistance heat layer;

a first pressure member provided inside a running path of the heat belt; and a second pressure member configured to press the first pressure member via the heat belt from over the running path of the heat belt to form the fixing nip, wherein the first pressure member is shorter than the second pressure member in the axis direction, at least one of the first pressure member and the second pressure member being a rotating body, the heat belt including a pressure-receiving area and two non-pressure areas, the pressure-receiving area receiving pressures from both the first pressure member and the second pressure member, and the non-pressure areas being arranged at outside of the pressure-receiving area in an axis direction of the rotating body, and two ring-like electrodes having been formed on circumferential surfaces of the respective two non-pressure areas and used to supply power to the resistance heat layer.

2. The fixing device of claim 1, wherein the electrodes are formed on an inner circumferential surface of the heat belt.

3. The fixing device of claim 2 further comprising:

a pair of power supply members configured to supply power to the resistance heat layer of the heat belt by contacting with the electrodes of the heat belt, wherein the power supply members press the electrodes against one of the first pressure member and the second pressure member that is longer in the axis direction than the other.

4. A fixing device for thermally fixing an unfixed image onto a recording sheet by causing the recording sheet, with the unfixed image formed thereon, to pass through a fixing nip, the fixing device comprising:

a heat belt formed in an endless shape and provided with a resistance heat layer;

a first pressure member provided inside a running path of the heat belt; and a second pressure member configured to press the first pressure member via the heat belt from over the running path of the heat belt to form the fixing nip, at least one of the first pressure member and the second pressure member being a rotating body, the heat belt including a pressure-receiving area and two non-pressure areas, the pressure-receiving area receiving pressures from both the first pressure member and the second pressure member, and the non-pressure areas being arranged at outside of the pressure-receiving area in an axis direction of the rotating body, two ring-like electrodes having been formed on circumferential surfaces of the respective two non-pressure areas and used to supply power to the resistance heat layer, and a length of the first pressure member and a length of the second pressure member in the axis direction of the rotating body are each smaller than a distance between the two ring-like electrodes in the axis direction.

5. The fixing device of claim 4, wherein the electrodes are formed on an outer circumferential surface of the heat belt.

6. The fixing device of claim 4, wherein the first pressure member is a pressure roller, and the second pressure member is a pressurizing roller.

7. The fixing device of claim 4, wherein the resistance heat layer is made of a heat-resistant insulating resin containing an electrically conductive filler dispersed therein.

8. A fixing device for thermally fixing an unfixed image onto a recording sheet by causing the recording sheet, with the unfixed image formed thereon, to pass through a fixing nip, the fixing device comprising:

a heat belt formed in an endless shape and provided with a resistance heat layer;

a first pressure member provided inside a running path of the heat belt; and a second pressure member configured to press the first pressure member via the heat belt from over the running path of the heat belt to form the fixing nip, at least one of the first pressure member and the second pressure member being a rotating body, the heat belt including a pressure-receiving area and two non-pressure areas, the pressure-receiving area receiving pressures from both the first pressure member and the second pressure member, and the non-pressure areas being arranged at outside of the pressure-receiving area in an axis direction of the rotating body, and two ring-like electrodes having been formed on circumferential surfaces of the respective two non-pressure areas and used to supply power to the resistance heat layer, wherein at least one of the electrodes is formed on an inner circumferential surface of the heat belt, a length of the first pressure member and a length of the second pressure member in the axis direction of the rotating body are each larger than a distance between the two ring-like electrodes in the axis direction, and the first pressure member and the second pressure member are provided at positions having been offset from each other in the axis direction.

9. The fixing device of claim 8, wherein the first pressure member is a pressure roller, and the second pressure member is a pressurizing roller.

10. The fixing device of claim 8, wherein the resistance heat layer is made of a heat-resistant insulating resin containing an electrically conductive filler dispersed therein.

11. An image forming apparatus comprising a fixing device for thermally fixing an unfixed image onto a recording sheet by causing the recording sheet, with the unfixed image formed thereon, to pass through a fixing nip, the fixing device including:

a heat belt formed in an endless shape and provided with a resistance heat layer;

a first pressure member provided inside a running path of the heat belt; and a second pressure member configured to press the first pressure member via the heat belt from over the running path of the heat belt to form the fixing nip, wherein the first pressure member is shorter than the second pressure member in the axis direction, at least one of the first pressure member and the second pressure member being a rotating body, the heat belt including a pressure-receiving area and two non-pressure areas, the pressure-receiving area receiving pressures from both the first pressure member and the second pressure member, and the non-pressure areas being arranged at outside of the pressure-receiving area in an axis direction of the rotating body, and two ring-like electrodes having been formed on circumferential surfaces of the respective two non-pressure areas and used to supply power to the resistance heat layer.

12. The image forming apparatus of claim 11, wherein the electrodes are formed on an inner circumferential surface of the heat belt.

13. The image forming apparatus of claim 12 further comprising:

a pair of power supply members configured to supply power to the resistance heat layer of the heat belt by contacting with the electrodes of the heat belt, wherein the power supply members press the electrodes against one of the first pressure member and the second pressure member that is longer in the axis direction than the other.

14. An image forming apparatus comprising a fixing device for thermally fixing an unfixed image onto a recording sheet by causing the recording sheet, with the unfixed image formed thereon, to pass through a fixing nip, the fixing device including:

a heat belt formed in an endless shape and provided with a resistance heat layer;

a first pressure member provided inside a running path of the heat belt; and a second pressure member configured to press the first pressure member via the heat belt from over the running path of the heat belt to form the fixing nip, at least one of the first pressure member and the second pressure member being a rotating body, the heat belt including a pressure-receiving area and two non-pressure areas, the pressure-receiving area receiving pressures from both the first pressure member and the second pressure member, and the non-pressure areas being arranged at outside of the pressure-receiving area in an axis direction of the rotating body, two ring-like electrodes having been formed on circumferential surfaces of the respective two non-pressure areas and used to supply power to the resistance heat layer, and a length of the first pressure member and a length of the second pressure member in the axis direction of the rotating body are each smaller than a distance between the two ring-like electrodes in the axis direction.

15. The image forming apparatus of claim 14, wherein the electrodes are formed on an outer circumferential surface of the heat belt.

16. The image forming apparatus of claim 14, wherein the first pressure member is a pressure roller, and the second pressure member is a pressurizing roller.

17. The image forming apparatus of claim 14, wherein the resistance heat layer is made of a heat-resistant insulating resin containing an electrically conductive filler dispersed therein.

18. An image forming apparatus comprising a fixing device for thermally fixing an unfixed image onto a recording sheet by causing the recording sheet, with the unfixed image formed thereon, to pass through a fixing nip, the fixing device including:

a heat belt formed in an endless shape and provided with a resistance heat layer;

a first pressure member provided inside a running path of the heat belt; and a second pressure member configured to press the first pressure member via the heat belt from over the running path of the heat belt to form the fixing nip, at least one of the first pressure member and the second pressure member being a rotating body, the heat belt including a pressure-receiving area and two non-pressure areas, the pressure-receiving area receiving pressures from both the first pressure member and the second pressure member, and the non-pressure areas being arranged at outside of the pressure-receiving area in an axis direction of the rotating body, and two ring-like electrodes having been formed on circumferential surfaces of the respective two non-pressure areas and used to supply power to the resistance heat layer, wherein at least one of the electrodes is formed on an inner circumferential surface of the heat belt, a length of the first pressure member and a length of the second pressure member in the axis direction of the rotating body are each larger than a distance between the two ring-like electrodes in the axis direction, and the first pressure member and the second pressure member are provided at positions having been offset from each other in the axis direction.

19. The image forming apparatus of claim 18, wherein the first pressure member is a pressure roller, and the second pressure member is a pressurizing roller.

20. The image forming apparatus of claim 18, wherein the resistance heat layer is made of a heat-resistant insulating resin containing an electrically conductive filler dispersed therein.

* * * * *